US010183844B1

(12) United States Patent
Howes

(10) Patent No.: US 10,183,844 B1
(45) Date of Patent: Jan. 22, 2019

(54) MOVING WALKWAY WITH SEGMENTS

(71) Applicant: Universal City Studios LLC, Universal City, CA (US)

(72) Inventor: Gerald Kenneth Howes, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 15/801,231

(22) Filed: Nov. 1, 2017

(51) Int. Cl.

| | |
|---|---|
| ***B66B 29/08*** | (2006.01) |
| ***B66B 25/00*** | (2006.01) |
| ***B66B 21/10*** | (2006.01) |
| *A63G 3/00* | (2006.01) |
| *B61B 12/02* | (2006.01) |

(52) U.S. Cl.
CPC ..... *B66B 29/08* (2013.01); *B66B 21/10* (2013.01); *B66B 25/00* (2013.01); *A63G 3/00* (2013.01); *B61B 12/022* (2013.01)

(58) Field of Classification Search
CPC ..... B66B 29/08; B61B 12/022; B61B 1/02; B63B 27/00; B63B 27/22; A63G 3/00; A63G 1/00; B60P 1/64; B60P 1/6427
USPC ..... 198/324; 472/13; 414/352; 14/27, 34, 14/44, 54
See application file for complete search history.

(56) References Cited

U.S. PATENT DOCUMENTS 368,420 A * 8/1887 Pearsons ..... B61B 12/022 104/21
929,130 A * 7/1909 Helliesen ..... A63G 3/00 472/13
3,727,558 A * 4/1973 Winkle ..... B66B 29/08 104/21
4,543,886 A * 10/1985 Spieldiener ..... B62D 57/00 104/21
5,033,392 A * 7/1991 Schemitsch ..... A63G 3/00 104/28
5,197,923 A * 3/1993 Barber ..... A63G 3/00 104/86
5,558,198 A * 9/1996 Juarez ..... B66B 29/08 104/20
5,560,468 A 10/1996 Inoue
5,810,147 A 9/1998 Vanmoor
6,880,301 B2 4/2005 Hahn et al.
(Continued)

OTHER PUBLICATIONS

"Platform gap filler", Website: https://en.wikipedia.org/wiki/Platform_gap_filler, pp. 1-3 (Accessed on Nov. 1, 2017).

*Primary Examiner* — James R Bidwell
(74) *Attorney, Agent, or Firm* — Fletcher Yoder, P.C.

(57) ABSTRACT

In one embodiment, a system includes a plurality of extension modules coupled to a movable circuit, where each extension module of the plurality of extension modules contain a respective walking segment. Each extension module of the plurality of extension modules is also configured to extend the respective walking segment away from the movable circuit. The system also includes a controller configured to activate a set of extension modules of the plurality of extension modules to adjust a position of corresponding walking segments based on a position of a vehicle, where the corresponding walking segments are configured to substantially abut a surface of the vehicle to facilitate loading and unloading of passengers from the vehicle.

20 Claims, 10 Drawing Sheets

(56) References Cited

U.S. PATENT DOCUMENTS

| | | | | |
|---|---|---|---|---|
| 6,898,816 | B2 * | 5/2005 | Tholen | B64F 1/3055 14/69.5 |
| 7,784,405 | B2 * | 8/2010 | Rose | A63G 7/00 104/20 |
| 2010/0078291 | A1 * | 4/2010 | Fritsche | B66B 21/10 198/324 |

* cited by examiner

MOVING WALKWAY WITH SEGMENTS

BACKGROUND

The present disclosure relates generally to the field of amusement parks. More specifically, embodiments of the present disclosure relate to a moving walkway for loading and unloading guests from vehicle rides.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Amusement parks contain a variety of rides providing unique experiences to each park guest. Some amusement park rides include a path and vehicles that travel along the path. Typically, these paths begin at a loading station where guests enter and/or exit a vehicle and end at the same station, completing a circuit of the ride. Certain rides may include vehicles that do not stop at the loading station. Rather, the vehicles continue to travel along the path, albeit at a relatively slow speed to enable guests to enter and/or exit the vehicle. In some cases, a ride may use a platform that travels at substantially the same speed as the vehicle at the loading station to facilitate loading and unloading from the vehicle. These moving platforms may form a loop that travels with the vehicle. Edges of the platform are generally straight lines and are positioned to be in contact, or close to contact, with the vehicle. However, it is now recognized that the vehicles may not include flat surfaces and thus, gaps may form in between the vehicle and the platform. Further, it is now recognized that the gaps may cause difficulties for guests getting on or off the vehicles.

BRIEF DESCRIPTION

In one embodiment, a system includes a plurality of extension modules coupled to a movable circuit, where each extension module of the plurality of extension modules contain a respective walking segment. Each extension module of the plurality of extension modules is also configured to extend the respective walking segment away from the movable circuit. The system also includes a controller configured to activate a set of extension modules of the plurality of extension modules to adjust a position of corresponding walking segments based on a position of a vehicle, where the corresponding walking segments are configured to substantially abut a surface of the vehicle to facilitate loading and unloading of passengers from the vehicle.

In another embodiment, a method includes actuating rotation of a movable circuit adjacent to a loading station, receiving a first indication of a vehicle entering a first zone of the loading station, initiating extension of one or more walking segments via one or more corresponding extension modules in response to the vehicle entering the first zone, receiving a second indication of the vehicle entering a second zone of the loading station, maintaining a position of the one or more extended walking segments in an extended condition in response to the vehicle entering the second zone, receiving a third indication of the vehicle exiting the second zone, such that the one or more extended walking segments substantially maintain abutment with the vehicle, receiving a third indication of the vehicle exiting the second zone of the loading station, and initiating retraction of the one or more walking segments in response to the vehicle exiting the second zone of the loading station, such that the one or more segments no longer substantially abut the vehicle. A controller is utilized to perform the functions of the method. The one or more corresponding extension modules are coupled to the movable circuit and the one or more walking segments are configured to substantially abut a surface of the vehicle to facilitate loading and unloading passengers from the vehicle.

In another embodiment, a non-transitory, computer-readable medium comprising computer-executable instructions which when executed are configured to cause a processor to detect a vehicle entering a first zone of a loading station and extend a set of walking segments in response to the vehicle entering the first zone. Each walking segment of the set of walking segments is coupled to a respective extension module of a plurality of extension modules disposed on a rotating movable circuit and the set of walking segments is configured to conform to a surface of the vehicle to facilitate loading and unloading passengers from the vehicle. When executed, the instructions also cause the processor to detect the vehicle entering a second zone of the loading station, maintain extension of the set of walking segments in response to the vehicle entering a second zone adjacent to the movable circuit, detect the vehicle exiting the second zone, and retract the set of walking segments in response to detecting the vehicle exiting the second zone.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
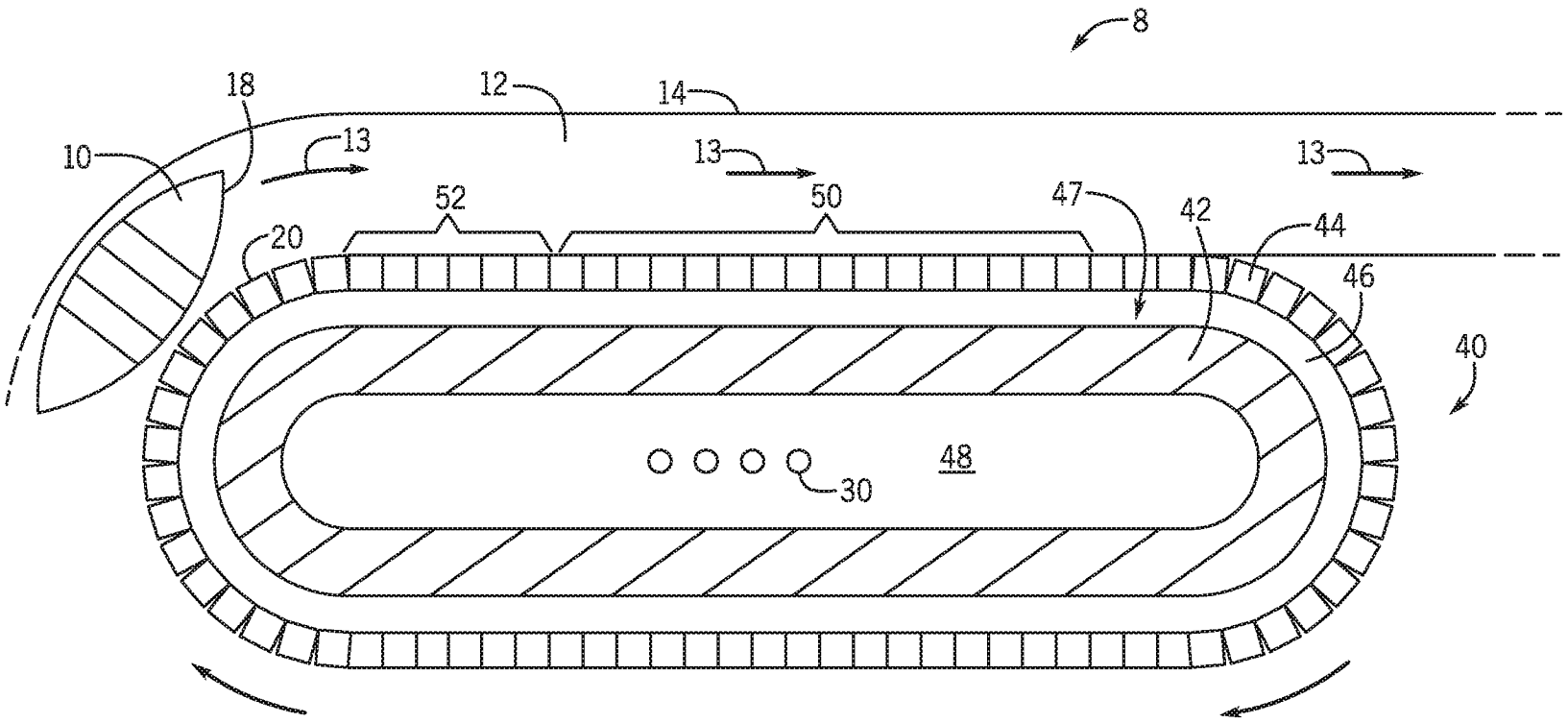
FIG. 1 is a plan view of an embodiment of a ride station, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to an automated loading area for amusement park rides. Amusement parks include a wide variety of features, such as roller coasters, motion simulators, and water rides. Many of the features make use of a vehicle that travels along a path (e.g., a track or waterway). These features may include a loading station at some point along the path where current guests exit the vehicle and where new guests enter the vehicle. Some features may use multiple stations along the path where incoming guests are typically lined up in a queue before entering a respective vehicle.

In certain features, the vehicles do not stop at the loading stations (e.g., log flumes, dark rides). Instead, they continue to travel along the path at a reduced speed to enable guests to enter and/or exit the vehicle. Some features include a platform adjacent to the ride vehicle that moves along with the vehicle at substantially the same speed. In this manner, guests entering and/or exiting the vehicle do not have to adjust for a change of speed between the ground and the vehicle as they move into or out of the vehicle. These platforms are typically located after a stationary queue where guests line up before approaching the feature. The platforms may move similar to a conveyor belt in that it continuously loops as the ride operates. The edges of the platforms are typically straight lines that abut the path and/or the ride vehicle. However, a surface of a vehicle may not line up with the edge of the platform because there may be curves on the surface and/or there may be manufacturing tolerances between the path and the platform. As a result, gaps between the surface of the ride vehicle and the edge of the platform may exist. These spaces may make it difficult for guests to enter and/or exit the vehicles as well as for team members of the amusement park who help guests enter and/or exit vehicles. For example, dropping items into the gap may be a concern. Accordingly, a platform that reduces and/or eliminate such gaps between the platform and vehicles may be desired.

The disclosed loading station includes an adjustable assembly that conforms to the surface of the ride vehicle. Present embodiments are directed to walking segments that may extend and retract to contact, or come close to contacting (e.g., abut), the surfaces of the vehicles. The platform continuously loops within a loading station. As a vehicle approaches the loading station, the walking segments adjust to conform to the surface of the vehicle. After adjustment, guests may walk on the walking segments to enter or exit the vehicle in the loading station. The walking segments may adjust to conform to the vehicle outside of a load/unload zone where guests enter and/or exit the vehicle. In this manner, the disclosed platform reduces a size of the gaps between the platform and the ride vehicle to facilitate guest interaction with the vehicle.

Turning to the figures, FIG. 1 illustrates an embodiment of a loading station 8 of an amusement park feature that includes vehicles moving along a path, specifically a track 12, and a platform that moves alongside the vehicle. As shown in the illustrated embodiment of FIG. 1, a ride vehicle 10 is configured to move along the track 12 in a direction 13. The ride vehicle 10 is shown as having a canoe-shape, but the ride vehicle 10 may include any suitable shape. The track 12 may include a guard 14 to contain the ride vehicle 10 within the loading station 8. The loading station 8 may be a location where guests 30 load or unload from the ride vehicles 10 to a loading station assembly 40. Certain sections of the ride vehicle 10, such as a ride vehicle surface 18, may be adjacent to the platform edges 20 of the loading station assembly 40. The guard 14 and the platform edges 20 may guide the ride vehicle 10 along the track 12. The loading station assembly 40 may contain a movable circuit 42 (e.g., a belt), walking segments 44, and a cover 46. The walking segments 44 may extend laterally from the movable circuit 42 onto the track 12 to become proximate to the ride vehicle 10. While the walking segments 44 are shown as rectangular shapes in FIG. 1, the walking segments 44 may be any suitable shape (e.g., oval shaped or another prismatic shape). The cover 46 may be coupled to the movable circuit 42 at a side 47 and may be positioned on top of the walking segments 44 to protect the walking segments 44 from debris. In the illustrated embodiment, the movable circuit 42 moves (e.g., loops) in a single plane, which may be parallel to a plane of movement of the ride vehicle 10 in the direction 13. In another embodiment, the movable circuit 42 may loop in a direction crosswise to the direction 13 traveled by the ride vehicle 10, such that movement of the movable circuit 42 is in a single plane that is crosswise to the plane of movement of the ride vehicle in the direction 13.

Within the loading station assembly 40 may be a stationary platform 48 where guests 30 may wait before entering the ride vehicle 10. In the illustrated embodiment, the movable circuit 42 loops around and surrounds the stationary platform 48, but in an alternate embodiment, the stationary platform 48 extends over (e.g., covers) the movable circuit 42. Guests exiting the ride vehicle 10 may also use the stationary platform 48 to exit the loading station assembly 40. The stationary platform 48 may be made of wood, brick, metal, or any other material suitable to sustain the weight of multiple guests. The movable circuit 42, the walking segments 44, and the cover 46 may continuously loop (e.g., cycle) around the stationary platform 48 at substantially the same speed as the ride vehicle 10 when it enters the loading station assembly 40. In one embodiment, the movable circuit may rotate at a speed that substantially maintains a relative position of a walking segment 44 with respect to a surface of the ride vehicle 10 as the ride vehicle 10 travels along the movable circuit. In this manner, the walking segment 44 and the ride vehicle 10 move at substantially the same speed. Although FIG. 1 shows the loop to be an ellipse shape, the movable circuit 42 may cycle in any suitable shape that enables the walking segments 44 to be positioned adjacent to a section of the track 12 (or some other ride path) and form a closed circuit. The loading station assembly 40 may contain a load/unload zone 50 that spans a segment of the movable circuit 42 where guests enter/exit the ride vehicle 10. Further, there may be an adjustment zone 52 before the load/unload zone 50 where positions of the walking segments 44 are adjusted to become proximate to the ride vehicle surface 18. The load/unload zone 50 and the adjustment zone 52 are discussed in further detail with reference to FIGS. 3-7.

Figure 2:
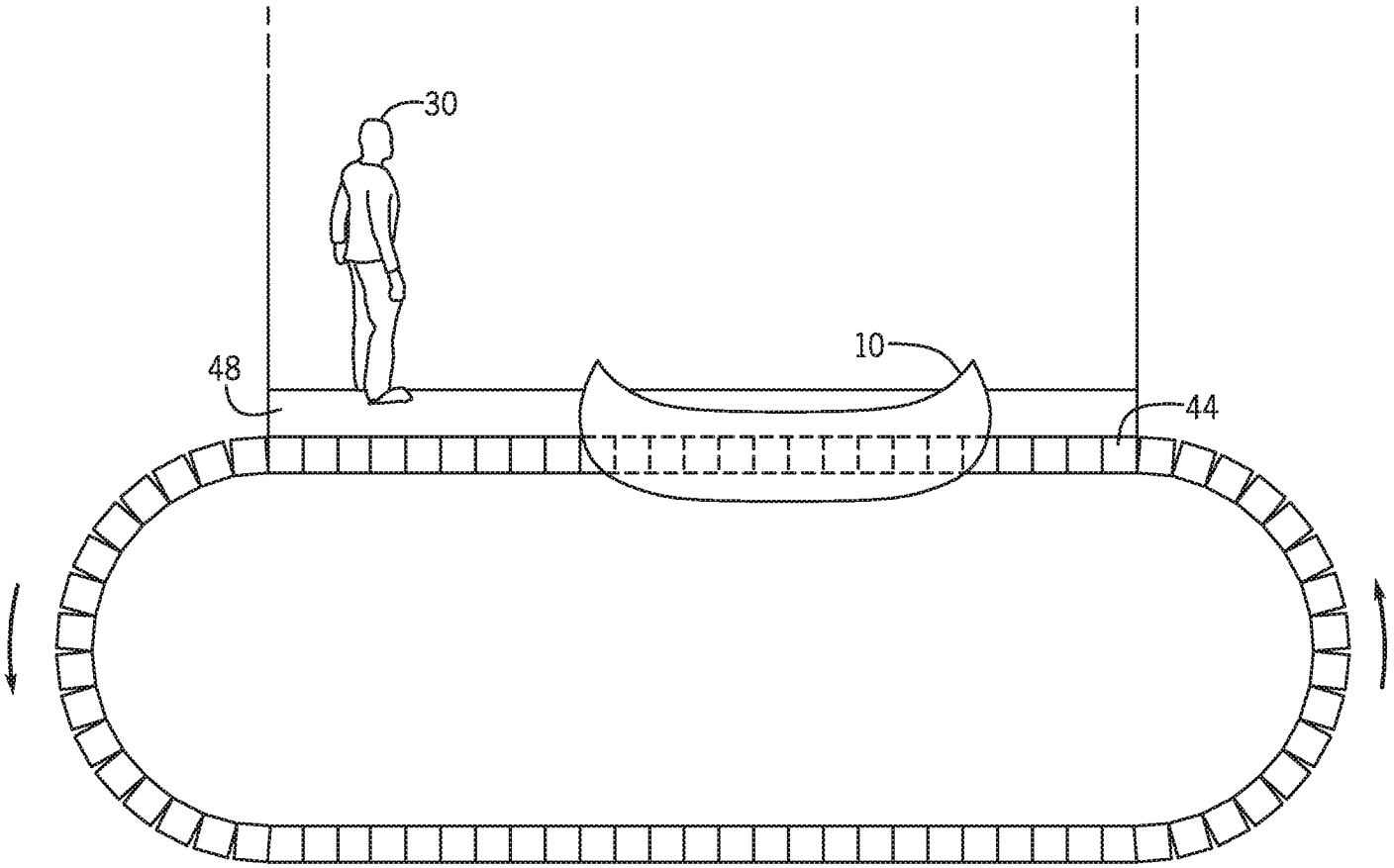
FIG. 2 is a schematic elevation view of an embodiment of a ride station, in accordance with an aspect of the present disclosure.

FIG. 2 illustrates another embodiment of the loading station 8 with the ride vehicle 10. FIG. 2 is a schematic elevation view of the loading station assembly 40 having the movable circuit 42, where the movable circuit 42 rotates in a different manner than that depicted in FIG. 1. As shown in FIG. 2, the movable circuit 42 does not rotate around the stationary platform 48, but rather rotates alongside and below it. That is, after traveling alongside the load/unload zone 50, the movable circuit 42 may be directed below the track 12 where the movable circuit 42 curves below the stationary platform 48 before looping around in an elliptical shape to return alongside the stationary platform 48.

Figure 3:
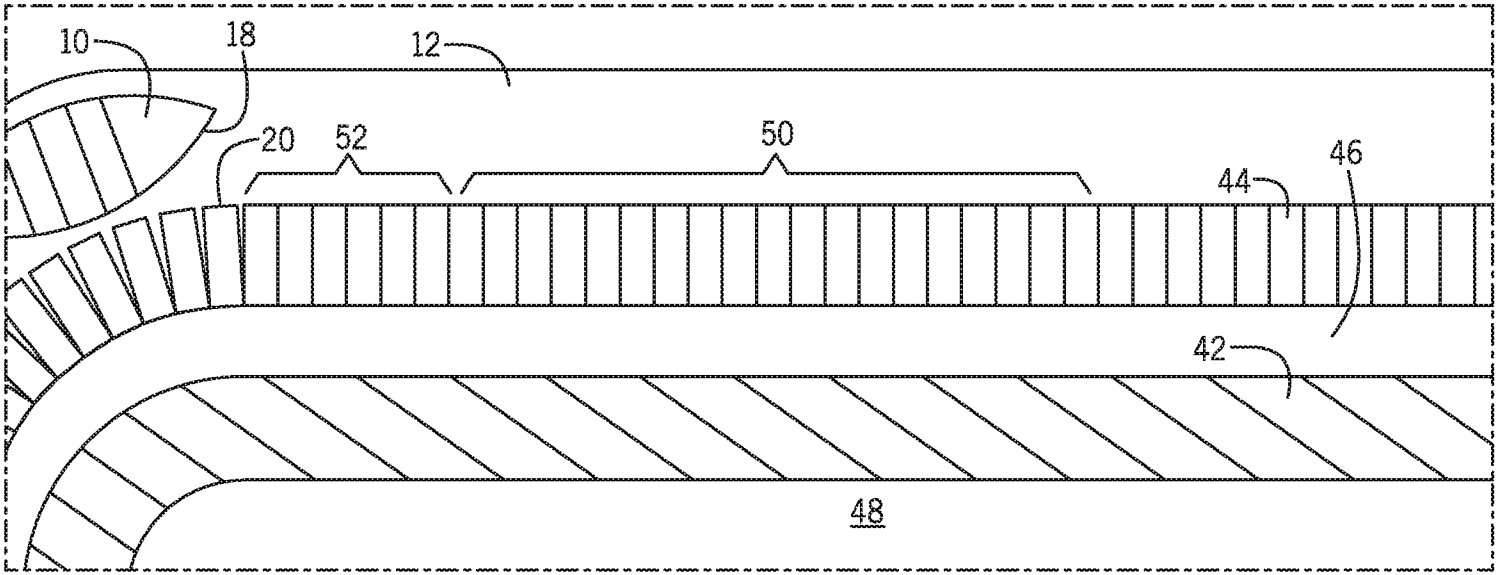
FIG. 3 is a plan view of an embodiment of a section of the ride station of FIG. 1, in accordance with an aspect of the present disclosure.

FIGS. 3-7 illustrate a sequence of the ride vehicle 10 moving through the loading station assembly 40 and adjustments of the walking segments 44 to conform to the ride vehicle 10. FIG. 3 shows the ride vehicle 10 entering the loading station assembly 40 of FIG. 1 prior to the adjustment zone 52. As seen in FIG. 3, before the ride vehicle 10 enters the adjustment zone 52, the ride vehicle surface 18 is not always in immediate contact with, or proximate to, the platform edge 20. There may be gaps in between the ride vehicle surface 18 and the platform edge 20 due to the shape of the ride vehicle 10. If these gaps were maintained, they may create difficulty for guests and team members when loading and/or unloading the vehicle.

Figure 4:
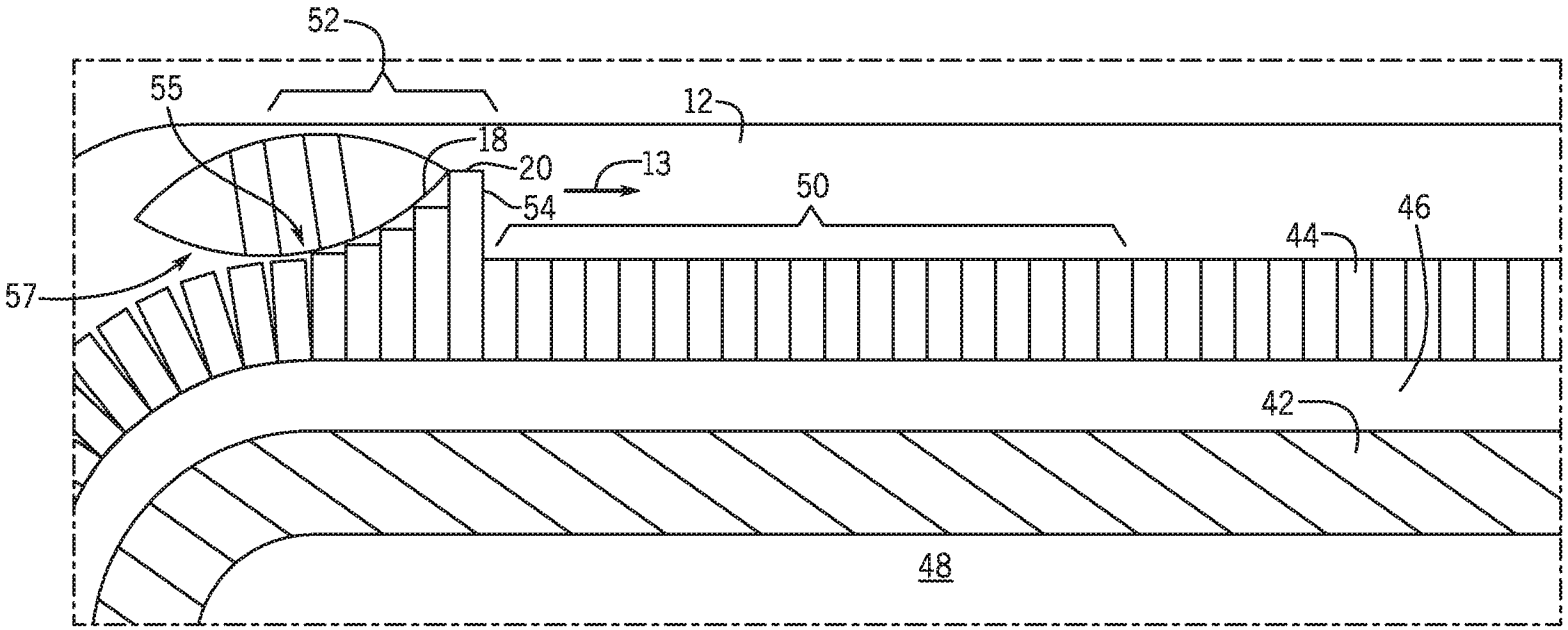
FIG. 4 is a plan view of an embodiment of another section of the ride station of FIG. 1, in accordance with an aspect of the present disclosure.

FIG. 4 shows the ride vehicle 10 entering the adjustment zone 52 of the loading station assembly 40 of FIG. 1. When the ride vehicle 10 enters the adjustment zone 52, at least a portion of the walking segments 44 within the adjustment zone 52 extend laterally from the movable circuit 42 to become more proximate (e.g., to substantially abut) to the ride vehicle surface 18. In this manner, the gaps between the ride vehicle surface 18 and the platform edge 20 are reduced. As the walking segments 44 extend laterally, the movable circuit 42 continues to rotate to move the walking segments 44 alongside the ride vehicle 10. The extending walking segments may include a leading walking segment 54 that is the walking segment most forward of the extending walking segments 44 with respect to the direction 13. As shown in the illustrated embodiment of FIG. 4, a first portion 55 of the ride vehicle 10 has entered the adjustment zone 52, such that some of the walking segments 44 are extended to a position proximate to the first portion 55 of the ride vehicle 10, and other walking segments 44 configured to extend to a position proximate to a second portion 57 of the ride vehicle remain retracted. Once the walking segments 44 are extended to the position proximate to the ride vehicle 10, their positions may be maintained until the movable circuit 42 begins to loop around past the load/unload zone 50. It should be noted that the load/unload zone 50 may be separated from the adjustment zone 52, such that guests may not access the adjustment zone 52. For example, in one embodiment, the stationary platform and/or the load/unload zone 50 may include physical barriers to block guests from accessing the movable circuit 42 and/or the adjustment zone 52.

Figure 5:
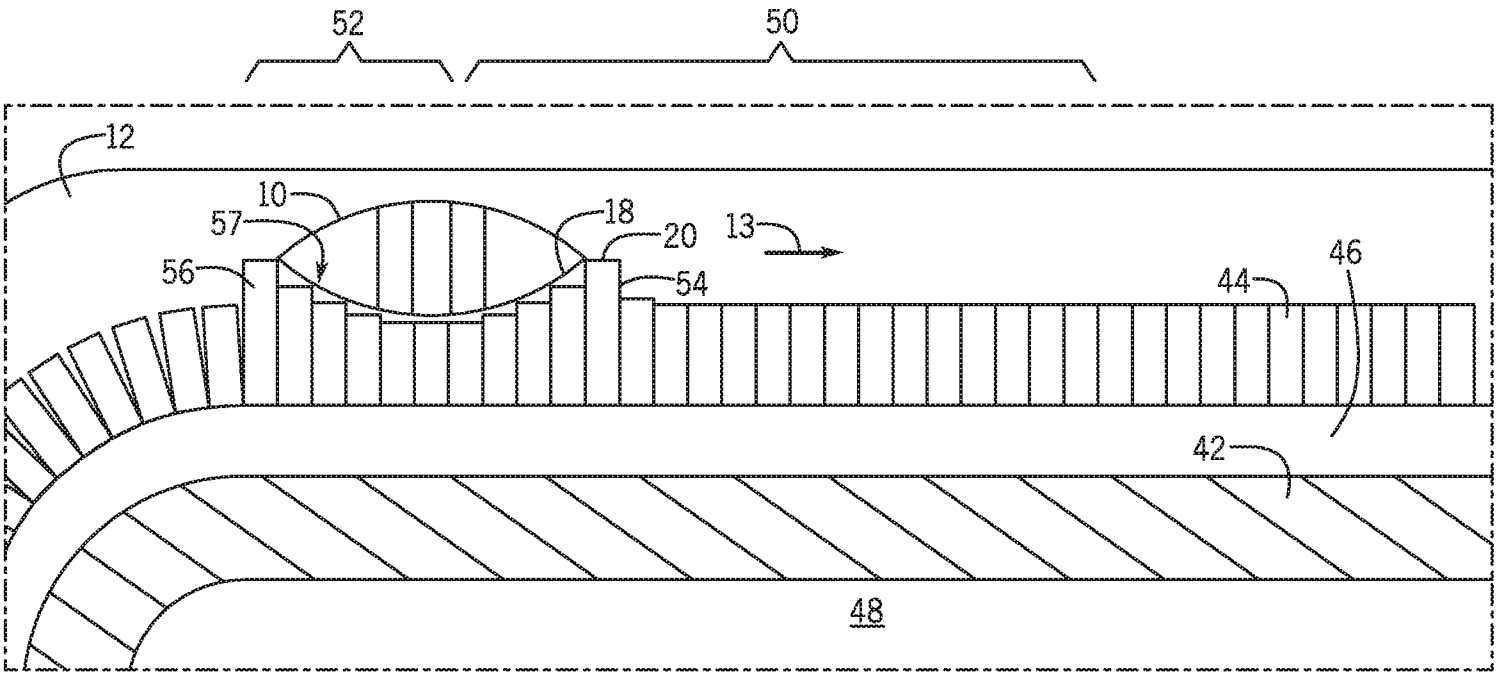
FIG. 5 is a plan view of an embodiment of another section of the ride station of FIG. 1, in accordance with an aspect of the present disclosure.

FIG. 5 shows the ride vehicle 10 entering the load/unload zone 50 of the loading station assembly 40 of FIG. 1. The second portion 57 of the ride vehicle 10 has entered the adjustment zone 52 and the corresponding walking segments 44 are extended to a position proximate to the ride vehicle 10. The corresponding walking segments 44 contain a trailing walking segment 56 that is the most rearward walking segment in proximity to the ride vehicle 10 and is located upstream of the leading walking segment 54 with respect to the direction 13. As shown in FIG. 5, the leading walking segment 54 remains the most forward segment proximate to the ride vehicle 10 as the ride vehicle 10 makes its way alongside the loading station assembly 40 in the direction 13. At this point, the gaps between the ride vehicle surface 18 and the platform edge 20 have been reduced as a result of the extension of the walking segments 44. The walking segments 44 that have entered the load/unload zone 50 may have their positions maintained throughout the load/unload zone 50 to prepare for loading and/or unloading of the ride vehicle 10. While some minor gaps remain in the illustrated embodiment due to linear edges of the walking segments 44, in an alternate embodiment, the walking segments 44 may include non-linear edges and/or include a deformable material that enables the walking segments 44 to conform to the ride vehicle surface 18 and reduce the size of the gaps.

Figure 6:
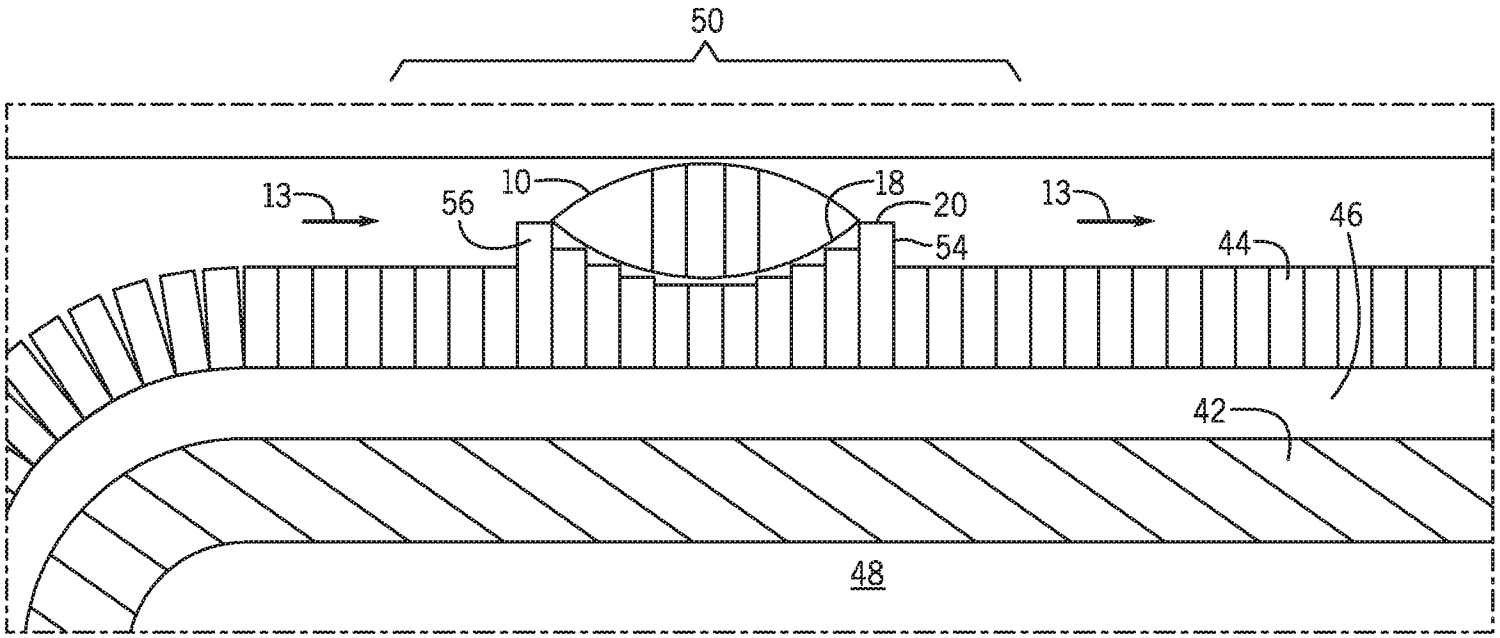
FIG. 6 is a plan view of an embodiment of another section of the ride station of FIG. 1, in accordance with an aspect of the present disclosure.

FIG. 6 shows the ride vehicle 10 fully within the load/unload zone 50 of the loading station assembly 40 of FIG. 1. As the walking segments 44 continue to move with the ride vehicle 10, the leading walking segment 54 remains the most forward segment in proximity to the ride vehicle 10 and trailing walking segment 56 remains the most rearward walking segment in proximity to the ride vehicle 10 with respect to the direction 13. The ride vehicle 10 is fully within the load/unload zone 50, so positions of the walking segments 44 that are adjacent to the ride vehicle 10 (e.g., the walking segments between and including the leading walking segment 54 and the trailing walking segment 56) are maintained such that guests may enter or exit the ride vehicle 10. When the walking segments 44 are extended, the movable circuit 42 may continue to rotate at a speed that substantially maintains a relative position of the extended walking segments 44 with respect to a surface of the ride vehicle 10 as the ride vehicle 10 travels along the movable circuit 42. Similar to FIG. 5, most of the gaps between the ride vehicle surface 18 and the platform edge 20 are reduced and thus, there is less difficulty for the guests to interact (e.g., enter and/or exit) with the ride vehicle 10.

Figure 7:
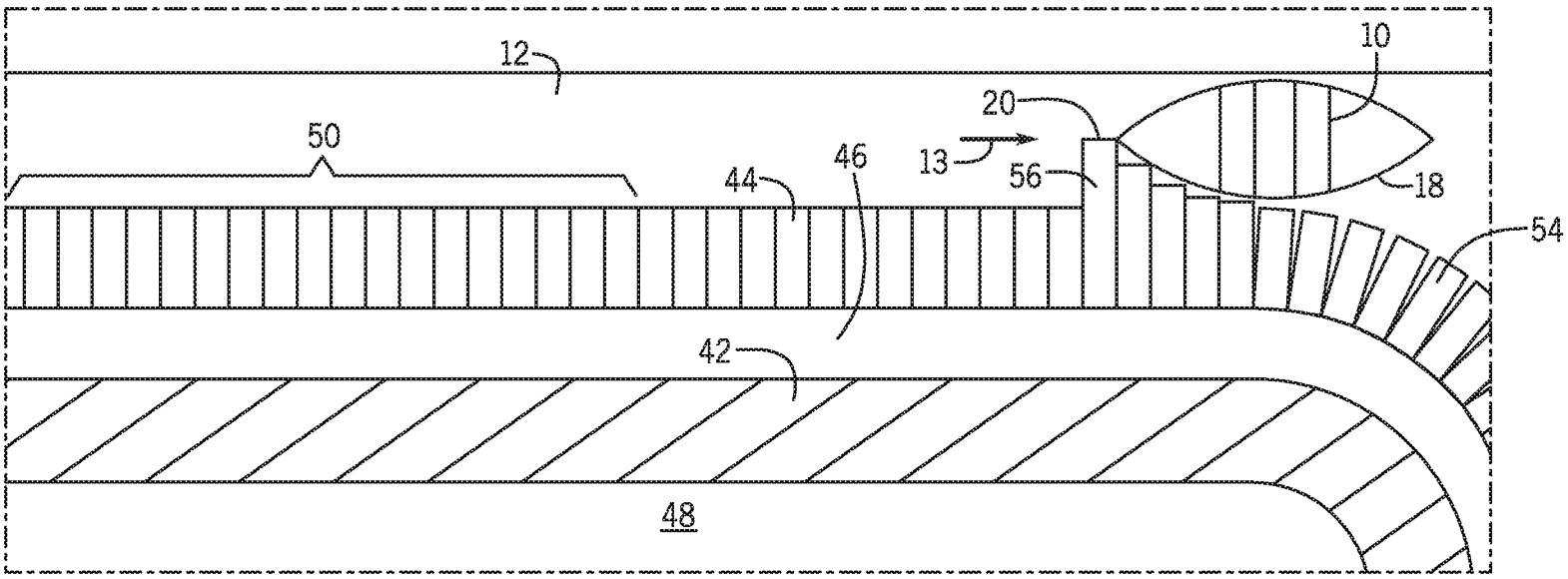
FIG. 7 is a plan view of an embodiment of another section of the ride station of FIG. 1, in accordance with an aspect of the present disclosure.

FIG. 7 shows the ride vehicle 10 exiting the load/unload zone 50 of the loading station assembly 40 of FIG. 1. As seen in FIG. 7, the leading walking segment 54 has retracted back toward the movable circuit 42 to remove any obstruction to the ride vehicle 10 as it continues along the track 12 in the direction 13. Positions of certain walking segments 44, including the trailing walking segment 56, may be maintained until they enter an area in which the walking segments 44 begin to loop around (e.g., back toward the adjustment zone 52). After retraction, the walking segments 44 remain in a retracted position until re-entering the adjustment zone 52.

Although FIGS. 1-7 depict the amusement park feature having one ride vehicle 10, it should be recognized that there may be more than one ride vehicle 10 traveling on the track 12 and entering or exiting the loading station 8. Furthermore, FIGS. 1-7 show a finite number of walking segments 44 at the loading station assembly 40, but there may be any number of walking segments 44 associated with the movable circuit 42.

Figure 8:
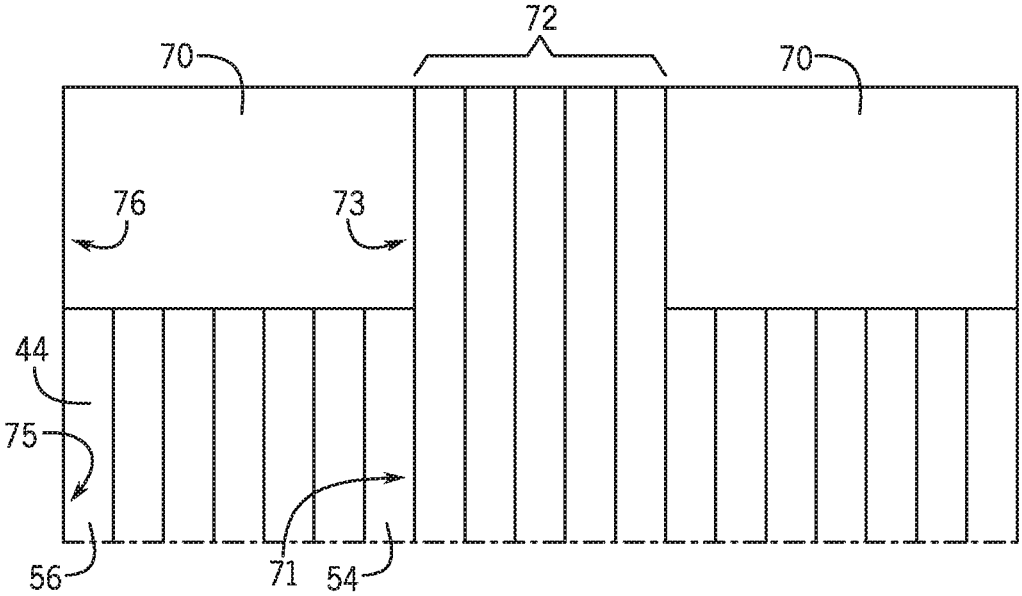
FIG. 8 is a plan view of an embodiment of the ride station of FIGS. 1-7 with walking segments conforming to a shape of a ride vehicle, in accordance with an aspect of the present disclosure.

FIG. 8 is a schematic of an embodiment of the walking segments 44 conforming to an embodiment of ride vehicles 70. In FIG. 8, the ride vehicles 70 are rectangular. As such, when the walking segments 44 extend, an edge 71 of the leading walking segment 54 may align with a surface 73 at the front of the ride vehicle 70 and an edge 75 of the trailing walking segment 56 may align with a surface 76 at the rear of the ride vehicle 70. Further, in between ride vehicles 70 is a transition zone 72. Walking segments 44 may extend within transition zone 72 to create a bridge of walking segments 44 disposed between the ride vehicles 70. In one embodiment, the shape of the ride vehicles 70 may not be rectangular (e.g., may be the canoe shape discussed above), but there may still be transition zones 72 between each ride vehicle 70, where walking segments 44 may extend to create the bridge to remove gaps between adjacent ride vehicles 70

Figure 9:
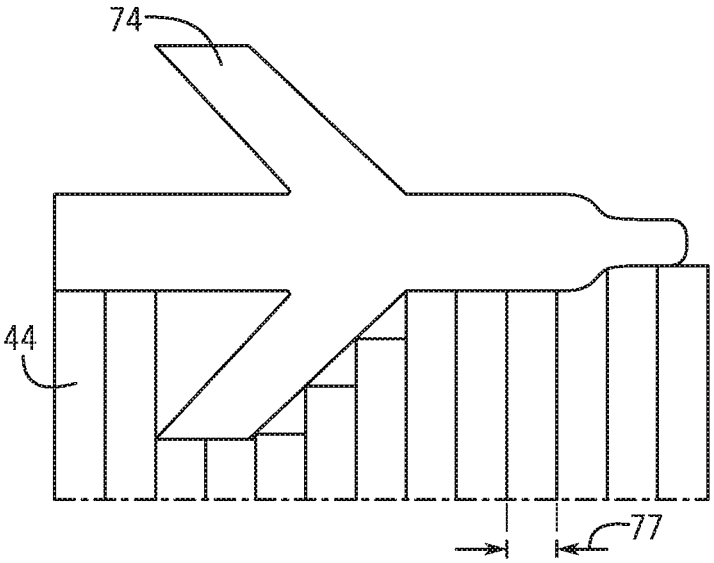
FIG. 9 is a plan view of an embodiment of the ride station of FIGS. 1-7 with walking segments conforming to the shape of a ride vehicle, in accordance with an aspect of the present disclosure.

FIG. 9 is a schematic of an embodiment of the walking segments 44 conforming to another embodiment of a ride vehicle 74. The ride vehicle 74 may include a relatively complex geometry, such as a plane shape. As shown in the illustrated embodiment of FIG. 9, the walking segments 44 may extend to a position proximate to the ride vehicle 74. In this manner, the shape of the ride vehicle 74 is not limited to simple geometries because the walking segments 44 may extend and become proximate to surfaces of any ride vehicle. Furthermore, the width 77 of each walking segment 44 may be reduced for features that include embodiments of ride vehicles with complex geometries. As such, there may be an increased number of walking segments 44 to adjust to the shape of the ride vehicles 74 to facilitate reducing the size of the gaps between the surfaces of the ride vehicles 74 and loading station 8.

Figure 10:
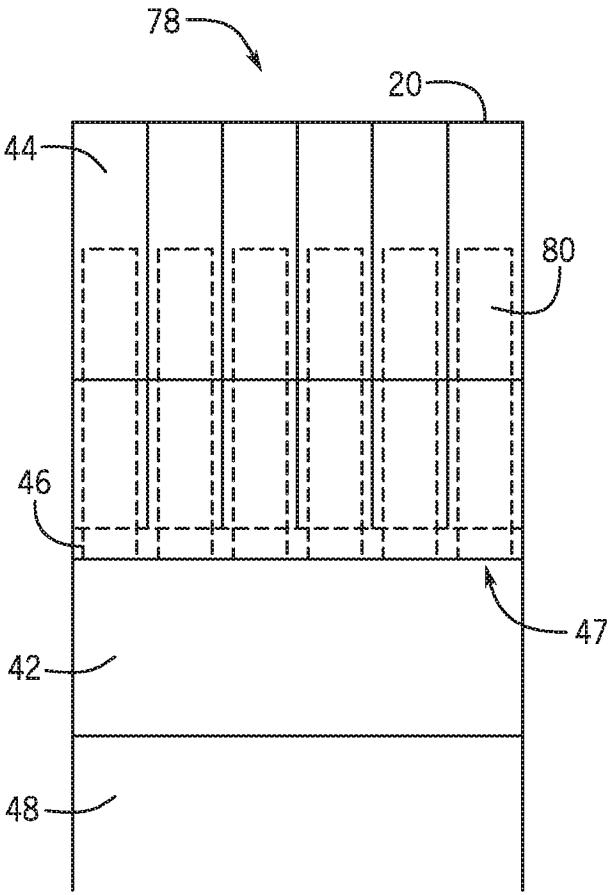
FIG. 10 is a plan view of a section of an embodiment of the ride station of FIGS. 1-9 prior to extension of walking segments, in accordance with an aspect of the present disclosure.

FIG. 10 illustrates a section 78 of walking segments 44 of the loading station assembly 40 and the structure of the section 78 prior to extension of the walking segments 44. The section 78 includes the stationary platform 48 where guests wait for ride vehicles 10 to approach the loading station assembly 40. In one embodiment, the movable circuit 42 may be coupled to the stationary platform 48 via a drive mechanism of the movable circuit 42 (e.g., roller bearings), which enables the movable circuit 42 to rotate about the stationary platform 48. Additionally, the cover 46 and a plurality of extension modules 80 may be coupled to the movable circuit 42 at the first side 47. The extension modules 80 may be located below the cover 46, which protects both the extension modules 80 and the walking segments 44 from debris and other possible contaminants. The walking segments 44 are coupled to the extension modules 80 but may remain below the cover 46. As such, the extension modules 80 are configured to extend and/or retract respective walking segments 44 and the extension modules 80 are configured to remain fixed to the movable circuit 42.

Figure 11:
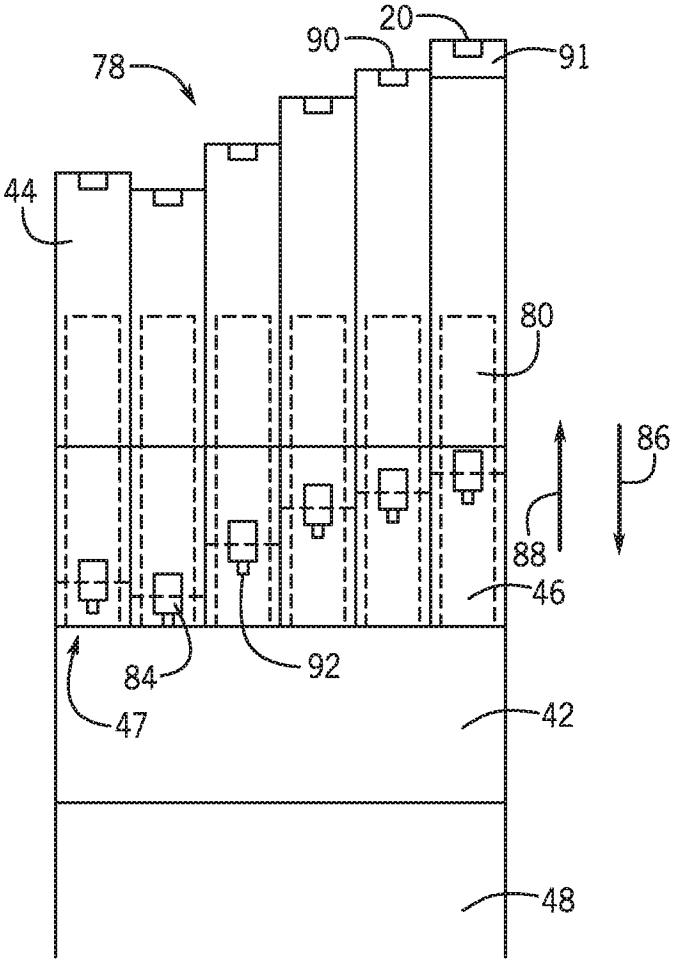
FIG. 11 is a plan view of a section of an embodiment of the ride station of FIGS. 1-9 after extension of walking segments, in accordance with an aspect of the present disclosure.

In FIG. 11, some of the walking segments 44 extend laterally from the movable circuit 42 to conform to a shape of a ride vehicle, for example. In one embodiment, the walking segments 44 may include a nesting or telescoping structure (e.g., multiple portions that fit inside one another) to facilitate extension toward the ride vehicle 10. As shown in FIG. 11, while the walking segments 44 are extended toward the ride vehicle 10, the extension modules 80 and the cover 46 may remain in the same positions. The extension modules 80 may contain actuators 84 to move the walking segments 44 laterally outward from the movable circuit 42 in a direction 86 or a direction 88, opposite the direction 86. The actuators 84 may include a spring, electric actuator, pneumatic actuator, hydraulic actuator, flexible paddle, another suitable component, or any combination thereof, to move walking segments 44 in directions 86 and/or 88.

In one embodiment, the extension modules 80 may be contact-based with sensors 90 disposed on the platform edge 20, such that upon contact with the ride vehicle 10, the extension modules 80 are prevented from further extending towards the ride vehicle 10. In an alternate embodiment, the extension modules 80 may be resistance-based with sensors 92 disposed internally (e.g., coupled to the actuators 84) to sense an amount of resistance encountered by the extension modules 80 when extending toward the ride vehicle 10. The extension modules 80 encounter resistance when contacting and pressing against the ride vehicle 10, and such resistance may be detected to eventually block the extension modules 80 from extending upon reaching a resistance threshold. In one embodiment, the walking segments 44 may include optical sensors that may detect when a walking segment 44 has extended to a suitable distance, such that the walking segment 44 is proximate to the ride vehicle 10. The optical sensor may be configured to provide feedback to a control system, which may block extension modules 80 from further extending the walking segment 44 toward the ride vehicle 10 when the optical sensor detects that the walking segment 44 is positioned proximate to the ride vehicle 10. In a further embodiment, the extension modules 80 continuously extend the walking segments 44 at a power that enables the walking segment 44 to maintain contact with the ride vehicle surface 18 without pushing the ride vehicle 10. Further, the walking segments 44 may contain rubber 91 or another suitable material 91 at the platform edge 20 (e.g., at a distal end of the walking segment 44) to reduce contact force and/or friction between the walking segment 44 and the ride vehicle 10. The walking segments 44 may also contain a flexible material (e.g., an elastic, rubber, or deformable material) that may conform to the ride vehicle surface 18 when the walking segments 44 contact the ride vehicle 10.

Figure 12:
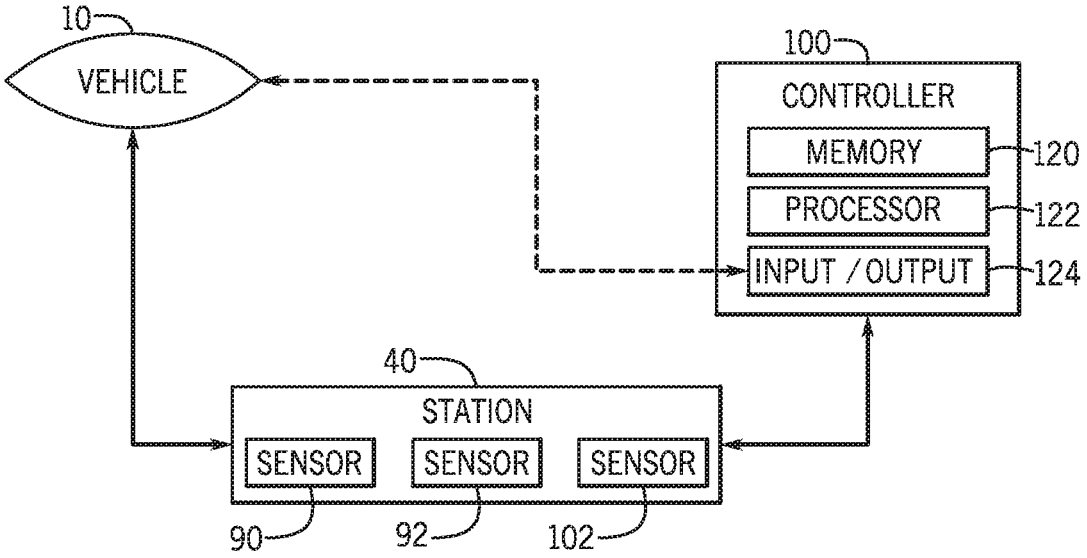
FIG. 12 is a schematic of a system including features used to operate the ride stations of FIGS. 1-11, in accordance with an aspect of the present disclosure.

FIG. 12 is a schematic of the loading station assembly 40, including the ride vehicle 10, loading station assembly 40, and a controller 100. The controller 100 may contain a memory 120, a processor 122, and input/outputs 124. The memory 120 may be a mass storage device, a flash memory device, removable memory, or any other non-transitory computer-readable medium that contains instructions regarding extension of the walking segments 44. The memory 120 may also include volatile memory such as randomly accessible memory (RAM) and/or non-volatile memory such as hard disc memory, flash memory, and/or other suitable memory formats. The processor 122 may execute the instructions stored in the memory 120. The input/output 124 may enable additional data (e.g., different vehicle shapes) from external sources to be input to the controller 100 and analyzed by the processor 122.

In one embodiment, the controller 100 may be communicatively coupled with the loading station assembly 40. As discussed, the loading station assembly 40 may include sensors 90 and/or 92 (e.g., optical or pressure sensors) that may be disposed on the walking segments 44 of the loading station assembly 40 to determine if the walking segments 44 are in the correct position of extension. In one embodiment, the loading station assembly 40 may further include sensors 102 that are disposed on the path (e.g., the track 12) to detect a presence of the ride vehicle 10 for adjusting portions of the corresponding walking segments 44. The loading station assembly 40 may contain optical sensors, light detection and ranging (LIDAR) systems, a laser detection system, or any combination thereof, which may detect the ride vehicle 10 at a position along the track 12. In an embodiment, the controller 100 may be programmed to automatically extend corresponding walking segments 44 at certain predetermined intervals of time. The time may be based at least in part on an amount of time for the ride vehicle 10 to complete a circuit defined by the track 12 and/or the time delay between ride vehicles entering the adjustment zone 52.

Figure 13:
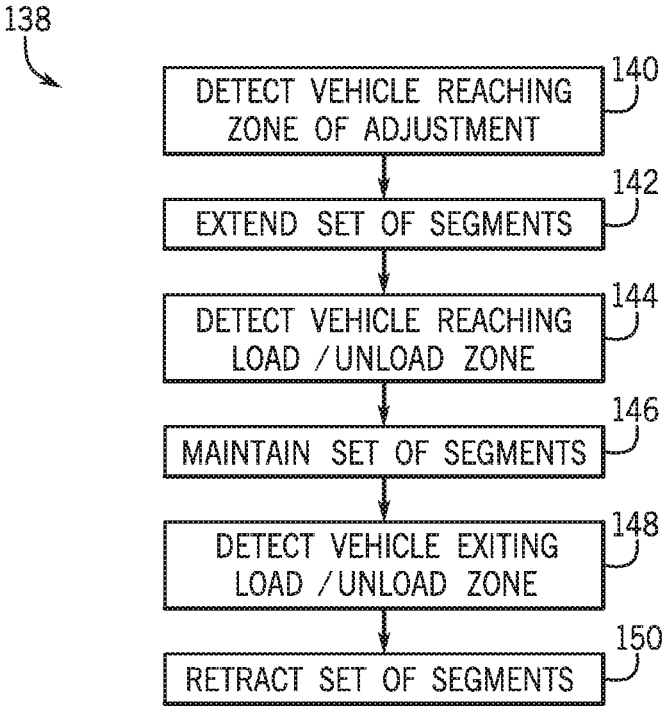
FIG. 13 is a flow chart of an embodiment of a process used to conform walking segments of FIGS. 1-12 to a shape of a ride vehicle, in accordance with an aspect of the present disclosure.

FIG. 13 is a flow chart depicting an embodiment of a process 138 executed by the controller 100 for using the loading station assembly 40. At block 140, the controller 100 receives a first signal that the ride vehicle 10 has entered the adjustment zone 52. In one embodiment, the signal may be transmitted by the sensor 90 and/or the sensor 92 disposed on the loading station assembly 40. In an embodiment, the controller 100 is programmed to send instructions at certain time intervals corresponding to times between ride vehicles 10 along the track 12. In response, the controller 100 extends the walking segments 44 that are positioned adjacent to the ride vehicle 10 (e.g., as shown at block 142). The walking segments 44 extend until they are in a position proximate to the ride vehicle surface 18. At block 144, the controller 100 receives a second signal that the ride vehicle 10 is in the load/unload zone 50. The second signal may be transmitted in a method similar to that in block 140. At block 146, the controller 100 maintains positions of the walking segments 44 to enable guests and team members to easily access the ride vehicle 10. At block 148, the controller 100 receives a third signal that the ride vehicle 10 is outside of the load/unload zone 50. The third signal may be sent in a method similar to that in block 144 and/or in block 140. At block 150, the controller 100 may retract the walking segments 44 as a result of the third signal. The walking segments 44 may then remain retracted until they have looped around and become adjacent to another ride vehicle 10 at the adjustment zone 52. The process 138 may repeat for all ride vehicles 10 that enter the loading station assembly 40.

While only certain features of the disclosure have been illustrated and described herein, many modifications and changes will occur to those skilled in the art. It is, therefore, to be understood that the appended claims are intended to cover all such modifications and changes as fall within the true spirit of the present disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a movable circuit;

a plurality of extension modules coupled to the movable circuit, wherein each extension module of the plurality of extension modules comprises a respective walking segment, and wherein each extension module of the plurality of extension modules is configured to extend the respective walking segment away from the movable circuit; and a controller configured to activate a set of extension modules of the plurality of extension modules to adjust a position of corresponding walking segments based on a position of a vehicle, wherein the corresponding walking segments are configured to substantially abut a surface of the vehicle to facilitate loading and unloading of passengers from the vehicle.

2. The system of claim 1, wherein the controller is configured to activate the set of extension modules, such that the corresponding walking segments extend to contact the surface of the vehicle.

3. The system of claim 2, wherein the respective walking segment comprises a sensor configured to sense contact between the respective walking segment and the surface of the vehicle.

4. The system of claim 2, wherein the respective walking segment comprises a sensor configured to measure resistance of contact between the respective walking segment and the vehicle.

5. The system of claim 2, wherein the respective walking segment comprises an optical sensor configured to detect a proximity of the respective walking segment to the vehicle.

6. The system of claim 1, wherein the respective walking segment comprises a rectangular shape.

7. The system of claim 1, wherein the movable circuit rotates at a speed that maintains a relative position of an extended walking segment with respect to a surface of the vehicle.

8. The system of claim 1, wherein each extension module of the plurality of extension modules comprises an actuator configured to extend and retract the respective walking segment.

9. The system of claim 1, comprising a cover coupled to the movable circuit and positioned above the respective walking segment.

10. The system of claim 1, wherein rotation of the movable circuit remains in a single plane.

11. The system of claim 1, wherein the respective walking segment comprises an elastic material on a distal end of the respective walking segment.

12. A method, comprising:

actuating, by a controller, rotation of a movable circuit of a loading station;

receiving, at the controller, a first indication of a vehicle entering a first zone of the loading station;

initiating, by the controller, extension of one or more walking segments via one or more corresponding extension modules in response to the vehicle entering the first zone of the loading station, wherein the one or more corresponding extension modules are coupled to the movable circuit, wherein the one or more walking segments are configured to substantially abut a surface of the vehicle to facilitate loading and unloading passengers from the vehicle;

receiving, at the controller, a second indication of the vehicle entering a second zone of the loading station;

maintaining, by the controller, the one or more extended walking segments in an extended condition in response to the vehicle entering the second zone, such that the one or more extended walking segments substantially maintain abutment with the vehicle;

receiving, at the controller, a third indication of the vehicle exiting the second zone of the loading station; and initiating, by the controller, retraction of the one or more walking segments away from the vehicle in response to the vehicle exiting the second zone of the loading station, such that the one or more walking segments no longer substantially abut the vehicle.

13. The method of claim 12, wherein extension of the one or more walking segments is performed via springs, electric actuators, pneumatic actuators, hydraulic actuators, or any combination thereof, disposed on the one or more corresponding extension modules.

14. The method of claim 12, wherein extension of the one or more walking segments comprises extending a first walking segment of the one or more walking segments until a sensor detects contact between the first walking segment and the vehicle.

15. The method of claim 12, wherein detecting the vehicle entering the first zone and the second zone is via optical sensors, LIDAR systems, laser detection system, or any combination thereof.

16. The method of claim 12, wherein a first walking segment of the one or more walking segments is extended, or retracted, or both, independently of a second walking segment of the one or more walking segments.

17. A non-transitory, computer-readable medium comprising computer-executable instructions which when executed are configured to cause a processor to:

detect a vehicle entering a first zone of a loading station;

extend a set of walking segments in response to the vehicle entering the first zone, wherein each walking segment of the set of walking segments is coupled to a respective extension module of a plurality of extension modules disposed on a rotating movable circuit, and wherein the set of walking segments is configured to conform to a surface of the vehicle to facilitate loading and unloading passengers from the vehicle;

detect the vehicle entering a second zone of the loading station adjacent to the movable circuit;

maintain extension of the set of walking segments in response to the vehicle entering the second zone;

detect the vehicle exiting the second zone; and retract the set of walking segments in response to detecting the vehicle exiting the second zone.

18. The non-transitory, computer-readable medium of claim 17, wherein the set of walking segments extend and retract laterally away from and toward the movable circuit.

19. The non-transitory, computer-readable medium of claim 17, wherein each extension module of the plurality of extension modules comprises an actuator to extend and retract the set of walking segments.

20. The non-transitory, computer-readable medium of claim 17, wherein the processor is configured to repeat execution of the instructions at predetermined time intervals corresponding to time delays between ride vehicles entering the first zone.

* * * * *